US005974755A

United States Patent [19]

Pouwels

[11] Patent Number: 5,974,755

[45] Date of Patent: Nov. 2, 1999

[54] WALL PATCH AND REPAIR OF BASEMENT WALLS

[76] Inventor: James F. Pouwels, 4298 Pouwels Ct., DePere, Wis. 54115

[21] Appl. No.: 09/022,773

[22] Filed: Feb. 12, 1998

[51] Int. Cl.[6] ..... E02D 37/00

[52] U.S. Cl. ..... 52/514; 52/169.5; 52/514.5

[58] Field of Search ..... 52/514, 514.5, 52/169.5, 169.14, 287.1, 288.1, 302.1, 302.3, 602, 630; 428/157, 163, 107, 177, 192

[56] References Cited

U.S. PATENT DOCUMENTS

| | | | |
|---|---|---|---|
| 3,850,193 | 11/1974 | Guzzo . | |
| 3,852,925 | 12/1974 | Gazzo . | |
| 3,990,469 | 11/1976 | Ralston . | |
| 4,309,855 | 1/1982 | Pate et al. . | |
| 4,574,541 | 3/1986 | Raidt et al. . | |
| 4,745,716 | 5/1988 | Kuypers | 52/169.5 |
| 4,757,651 | 7/1988 | Crites . | |
| 4,962,622 | 10/1990 | Albrecht | 52/630 |
| 5,035,095 | 7/1991 | Bevilacqua . | |
| 5,325,643 | 7/1994 | Mitchell | 52/169.1 |
| 5,367,842 | 11/1994 | Janesky | 52/169.5 |
| 5,600,928 | 2/1997 | Hess et al. | 52/309.4 |
| 5,615,525 | 4/1997 | Kenworthy | 52/169.5 |
| 5,765,329 | 6/1998 | Huang | 52/302.3 |
| 5,775,039 | 7/1998 | McPherson | 52/169.5 |

*Primary Examiner*—Beth Aubrey
*Attorney, Agent, or Firm*—Ryan Kromholz & Manion, S.C.

[57] ABSTRACT

A wall patch for covering and draining an area of an interior foundation wall. The patch comprises a base member including a waterway profile having a longitudinally extending drain surface with at least one open end. The waterway lies between a pair of spaced-apart, upstanding curbs coextensive with the length of said drain surface. It is also preferred to provide a coextensive groove on the exposed surface of each curb to retain caulking compound for sealing the patch to the wall surface. The patch may be attached to the wall surface by means of conventional concrete screws.

10 Claims, 3 Drawing Sheets

WALL PATCH AND REPAIR OF BASEMENT WALLS

BACKGROUND OF THE INVENTION

This invention relates generally to drainage systems, and more particularly to wall patches for covering cracks occurring in concrete basement foundation walls. Keeping the basements of buildings dry is a recurring problem. Cracks develop in basement walls allowing water to leak into the basement and collect on the surface of basement floors.

Many efforts have been made to solve the problem. The usual approach to repair or attempts at prevention is to plug the holes from the outside of the foundation wall. Theoretically, this can be possible, but ordinarily it is not likely to be successful. It is very difficult to find all the holes or cracks, and even when located, it was difficult in the past to make a successful patch or plug. Further, to make repairs exteriorly of a wall, after a building has been in use for a period of time, is a relatively expensive process, and often will require ripping out landscaping, including bushes and trees, and even stone or concrete slabs that have been located adjacent the wall. Expensive equipment must also be brought to the site.

Examples of exterior wall drainage systems are represented in U.S. Pat. Nos. 3,852,925 granted to J. F. Gazzo on Dec. 10, 1974; 4,309,855 granted to H. T. Pate et al on Jan. 12, 1982; 4,574,541 granted to H. P. Raidt et al on Mar. 11, 1986 and 5,035,095 granted to J. Bevilacqua on Jul. 30, 1991. Attempts to repair water drainage problems from the basement interior have been disclosed in U.S. Pat. Nos. 3,850,193 granted to R. F. Guzzo on Nov. 26, 1974 and 4,757,651 granted to M. K. Crites on Jul. 19, 1988.

The disclosures of each of the prior art patents listed above entail relatively difficult and expensive procedures, let alone messy, and often complex, trenching procedures involved in removal of interfering trees, shrubs and other obstructions, in order to perform maintenance repairs to exterior foundation; wall surfaces of existing buildings. Prior efforts internally of the foundation wall required complex and relatively expensive and time-consuming techniques and relatively complex patching components.

SUMMARY OF THE INVENTION

The present invention is directed to a wall patch and patching technique for use on interior basement walls, and in particular, in connection with poured concrete basement foundation walls. The wall patch preferably embodies a unitary construction comprising a relatively thin base member made of an inexpensive plastic material. An intermediate collection and drainage surface extends for the length of the member, and is defined by a pair of longitudinally extending, laterally spaced, upstanding curbs. A trough or groove is preferably provided in the top surface of each of the upstanding curbs to receive caulking compound. The patch may additionally contain screw-receiving apertures for fastening a pre-caulked patch directly to the interior wall.

The wall patch may take the form of an elongated member, relatively flat along the longitudinal length thereof, or the patch may be bent in angular fashion, rearwardly of the curbs. The latter bent member finds use in corners of a foundation wall.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
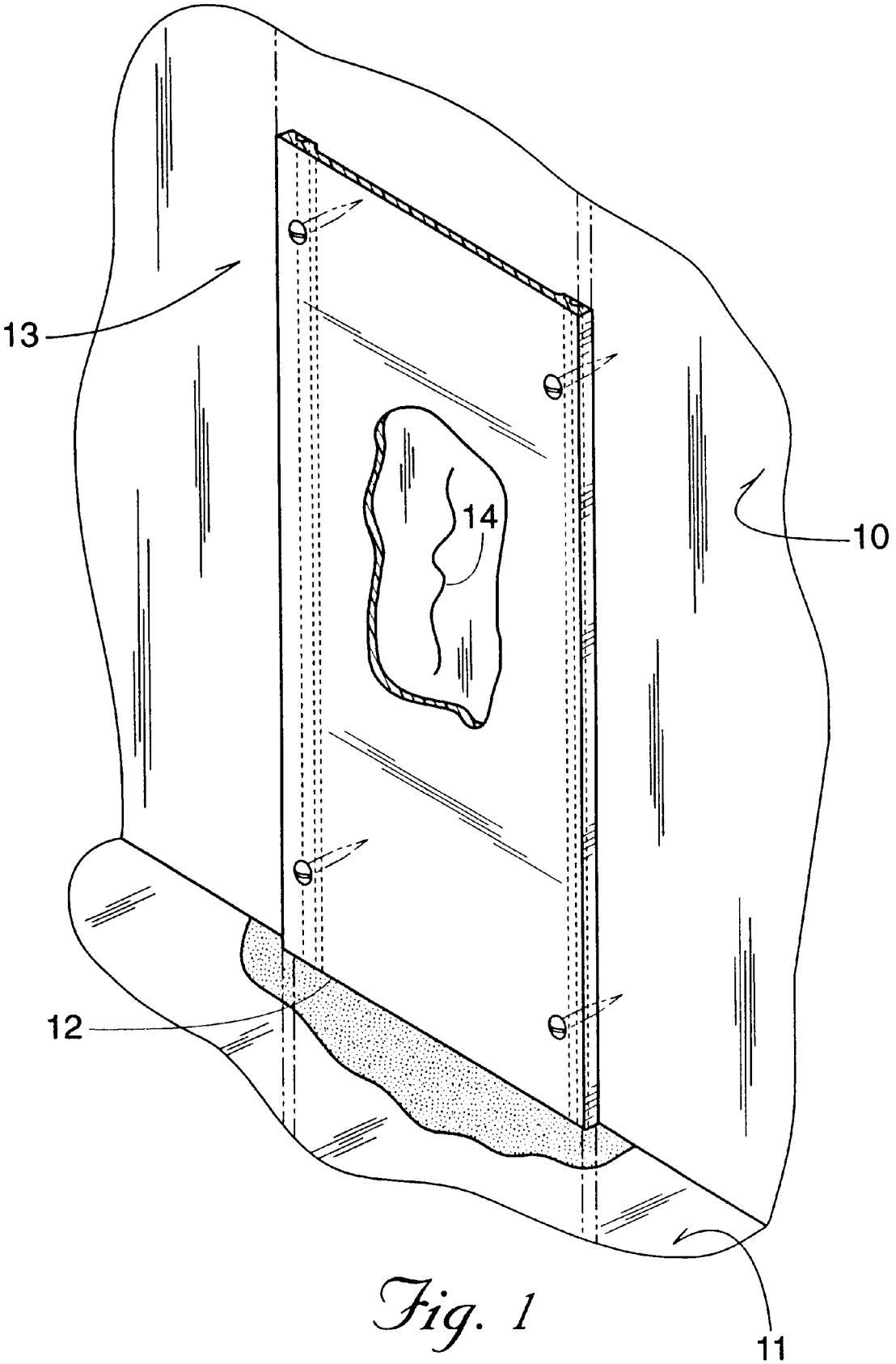
FIG. 1 is a perspective view depicting a conventional basement wall and floor, wherein a portion is broken away to illustrate the wall with a crack or fissure having water leaking therethrough. The drainage patch of the invention is shown applied to the interior surface of the wall.

With reference to FIG. 1, a vertical, longitudinally extending, wall is generally indicated by the reference numeral 10. The procedure and devices of this invention have particular application to poured concrete basement foundation structures. The vertical wall 10 rests upon a concrete floor 11.

The wall drainage system of this invention, as shown in FIG. 1, includes a wall patch, denoted generally by the reference numeral 13, and covering a leaking crack 14, which has occurred in the wall 10. The patch 13 not only covers the crack, but also, as will be hereinafter described, provides a waterway profile for guiding leaking drainage downwardly to an opening 12 previously made in the floor 11. The wall patch 13 is best described in connection with the views of FIGS. 2 and 3, wherein the waterway, denoted generally by the reference numeral 15, is formed in a base member 16 having a bottom surface 17. It is preferable for various reasons to mount the wall patch 13 on the interior surface of the wall 10, as shown in FIG. 1, with the bottom surface 17 facing the basement room.

As described above in the Background of the Invention, the present invention is intended to eliminate the necessity of working on the exterior surface of the basement wall 10. This type of installation is messy and costly, and often requires removal of shrubbery, trees, landscaping plantings and stone or concrete slabs adjacent to the wall. Trenching of the area is usually required to attain access to the exterior wall surface. Trenching is an additional costly procedure, requiring the use of special and expensive earth-working equipment. As above-mentioned, only a relatively small opening 12 need be made in the basement floor 11 to receive water draining downwardly along the waterway profile 15 from the crack 14. The opening generally can be made with simple tools such as pick and sledgehammer, or a small pneumatic hammer. The opening 12 may later be patched with conventional patching cement obtained from a local hardware outlet. This collected water drains downwardly through the backfill, crushed rock, and away from the foundation via the conventionally supplied drain tile (not shown).

Figure 2:
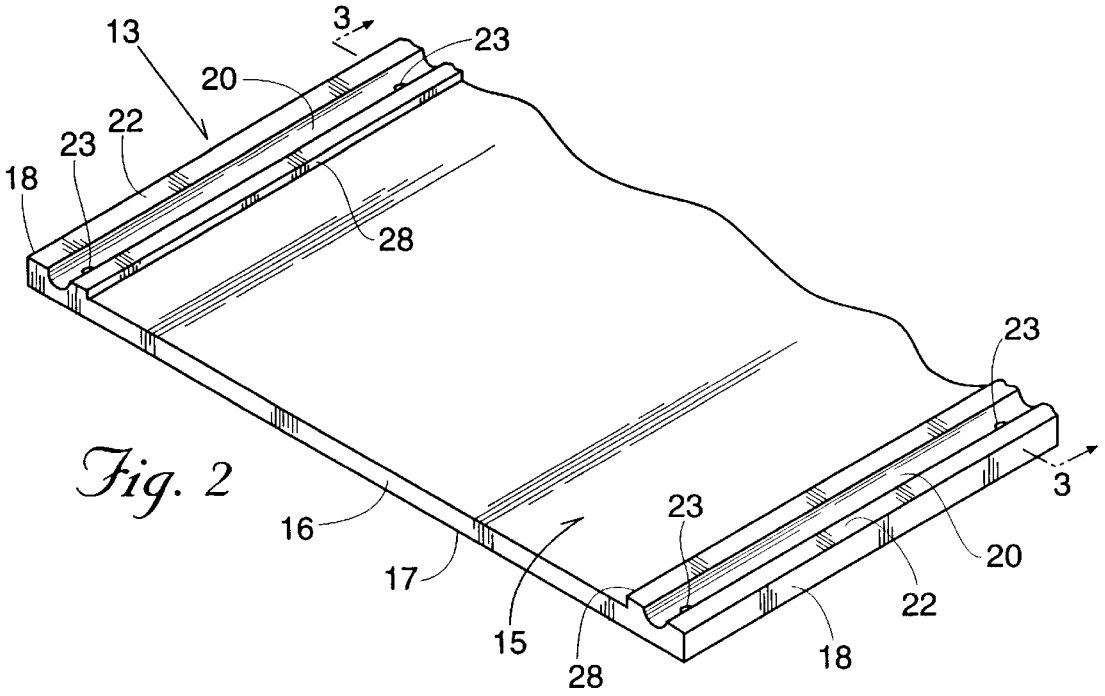
FIG. 2 is a perspective view showing a fragment of a drainage patch made in accordance with this invention.
Figure 3:
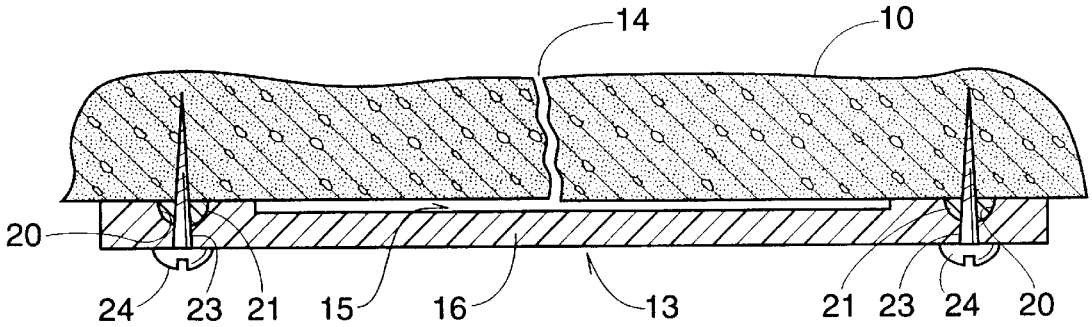
FIG. 3 is a cross-sectional view taken along the line 3—3 of FIG. 2, and additionally shown in mounting position on the basement wall.

Referring to the views of FIGS. 2 and 3, it will be observed that the wall patch 13 is preferably an integrally formed member of extended longitudinal length; usually in the order of eight (8) feet to reach cracks occurring below the usual foundation height. The height of the basement foundation ordinarily extends above ground line and leakage cracks are rarely found in the extended height portion. The patch 13 may be formed by machining a solid sheet of conventional High Density Polyethylene (HDPE). It is conceivable, however, to form the patch 13 by conventional extrusion or like molding procedures from conventional plastic suitable for such techniques.

The patch 13 preferably includes a pair of laterally spaced, upstanding, curbs 18 extending longitudinally coextensive with the length of the patch and defining the waterway profile 15 therebetween. Each of the curbs 18 preferably contains a coextensive caulking groove 20. The grooves 20 are intended to be slightly overfilled with a conventional caulking compound 21. The surplus caulking compound 21 is squeezed to lay between the wall 10 and the upper surfaces 22 of the curbs 18 during mounting of the patch 13 to the wall 10. The curbs 18 are preferably provided with longitudinally spaced apertures 23 for receiving conventional concrete mounting screws 24.

Figure 4:
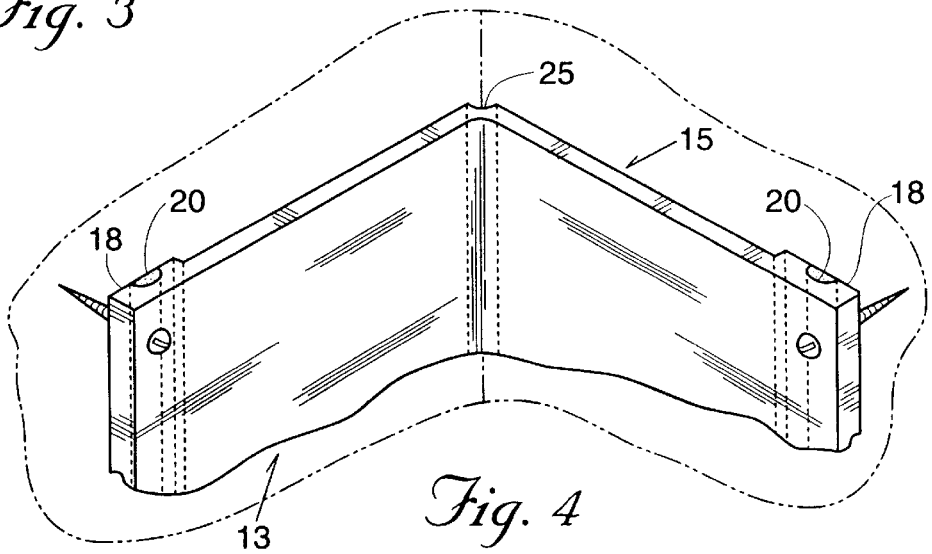
FIG. 4 is a perspective view of another embodiment of the invention having particular application for corners of a basement wall.

Next, attention is directed to the view of FIG. 4 which discloses another embodiment of the invention having particular application and use for patching and drainage of corners of basement walls. This embodiment provides a kerf or groove 25. The groove 25 coextends longitudinally of the patch 13 intermediate the width of the patch 13 and preferably along the surface of the waterway profile 15. The groove 25 provides a reduced thickness of the patch 13 along its length, thereby permitting facile and convenient bending of the patch by the installing contractor when a corner requires repair. The embodiment of FIG. 4 may also be made with a preformed angular configuration, if so desired. Further, the groove 25 may be formed by machining procedures, such as sawing to provided a kerf of conventional saw width, or it may be extruded or molded (not shown) according to conventional manufacturing techniques.

Figure 5:
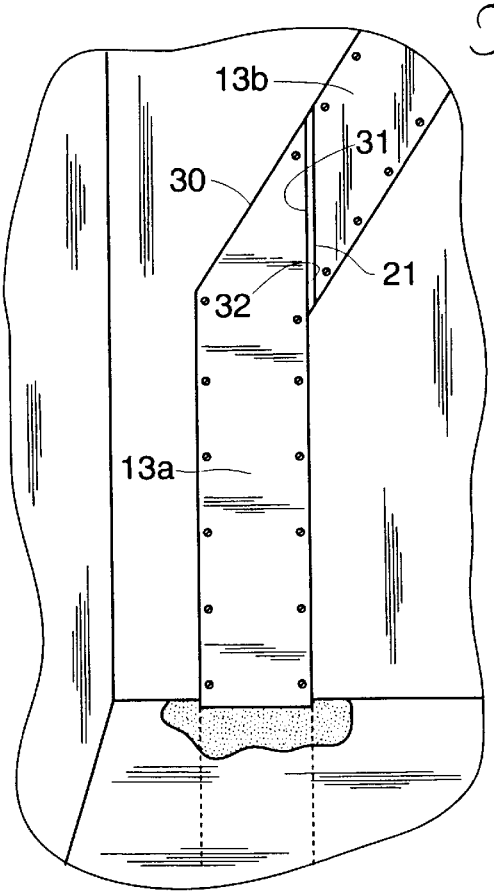
FIG. 5 is a fragmentary elevational view depicting another application of the wall patch of this invention, wherein the embodiment of FIGS. 2 and 3 are shown cut at desired angles and butt joined to provide an angularly directed waterway for drainage repair.
Figure 6:
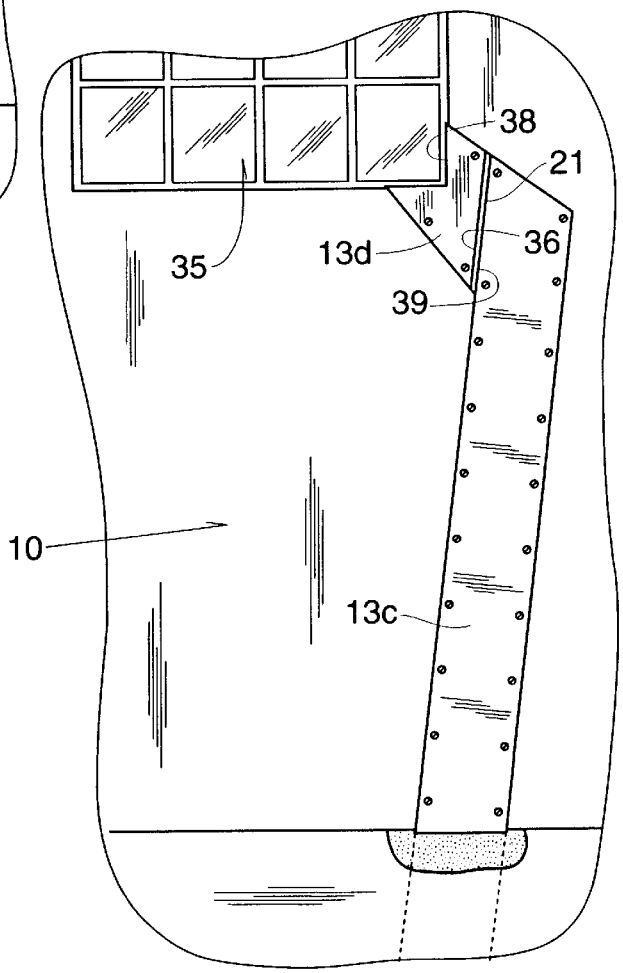
FIG. 6 is a fragmentary elevational view depicting a further application of the wall patch of this invention, wherein the patch is shown cut in two differently configured portions and positioned in juxtaposed configuration to provide a drainage waterway directing leakage water away from a basement window well.

As disclosed in the views of Figures. 5 and 6, the wall patch of this invention may be cut or fabricated into various configurations adapted to cover and drain cracks located angularly relative to the usual vertical positioning of an elongated patch, such as in the case of the embodiment shown in FIG. 1.

With attention being directed to FIG. 5, it will be noted that the patch portion 13*a* may be positioned vertically, and trimmed or cut on the bias at the top surface 30 to accommodate an angularly positioned patch portion 13*b* including an angular cut or formed surface 31. The surface 31 will be in abutting contact with a side surface portion 32 in the patch portion 13*a*. The side surface portion 32 may be trimmed to desired configuration at the repair site. This techniques is not shown, but simply requires removal by sawing, or other conventional means, of a portion of the curb 18 at one side of the portion 13*a*, and of a sufficient length to meet the abutting surface 31 of the angular patch portion 13*b*. Usual caulking procedures are used to further seal the waterway defined by the joined portions 13*a* and 13*b*.

A further embodiment of the invention is disclosed in the view of FIG. 6, wherein a patch portion 13*c* trimmed at its ends to be disposed angularly relative to a the interior wall 10 of a leaking window well 35. A cutaway surface portion 36 is may be trimmed on site, as in the case of surface 32 of the embodiment of FIG. 5. The surface 36 is abutted with and joined to a patch portion 13*d,* with a surface portion 38 of portion 13*d* being trimmed to provide a specifically desired configuration The surface 39 abuts potion 36 similar to the abutting relationship between surface 31 and side surface portion 32 of FIG. 5. The configured trimming may be accomplished with conventional tools, and on site, as described in connection with the view of FIG. 5.

The HDPE plastic that is preferred in the manufacture of the wall patch 13 might be painted, if so desired. It is recommended, however, that paint, such as a conventional auto refinishing paint be used. The reason for this is that auto refinishing paint includes an elastic element that permits expansion due to temperature changes.

It will be apparent that the present invention provides a simplified wall patch and procedure for covering and draining leaks occurring in basement foundation walls and, in particular, the invention permits ready and inexpensive patches and procedures that may be performed from the interior of the basement. The invention virtually eliminates the need for patching leaks from the exterior of the basement, thereby eliminating expensive, messy trenching procedures, and further eliminating the need for removal of landscaping objects and pre-laid concrete walk slabs.

The foregoing is considered as illustrative only of the principles of the invention. Furthermore, since numerous modifications and changes will readily occur to those skilled in the art, it is not desired to limit the invention to the exact construction; and operation shown and described. While preferred embodiments have been described, the details may be changed without departing from the invention, which is defined by the claims.

What is claimed is:

1. A wall patch for covering and draining an area of an interior foundation wall having a liquid drainage crack developed therein, said patch comprising a base member having a longitudinally extending waterway drain surface with at least one open end, said drain surface lying between a pair of spaced-apart, upstanding curbs coextensive with the length of said drain surface, each of said curbs having an uppermost surface, said uppermost surface of said curbs having a recessed caulking groove coextensive and parallel with said uppermost surfaces.

2. The wall patch of claim 1, wherein said curbs are integrally formed therewith.

3. The wall patch of claim 1, wherein the patch is integrally formed and lies in a relatively flat plane.

4. The wall patch of claim 1, wherein the patch includes an angular bend intermediate its length and in a direction opposed to the surface containing the pair of curbs.

5. The wall patch of claim 1, wherein each of said curbs contains longitudinally spaced, screw-receiving apertures.

6. A wall drainage system for use on a vertically extending foundation wall having a liquid drainage crack developed therein, comprising at least one wall patch applied to the inwardly facing foundation wall and arranged to overlay said crack, said patch comprising a base member having a waterway drain surface spaced from said inwardly facing wall surface by means of a pair of upstanding spaced-apart curbs lying coextensive of the length of said wall patch, each of said curbs having an uppermost surface, said uppermost surface of said curbs having a recessed caulking groove coextensive and parallel with said uppermost surfaces, said wall patch provided with caulking compound disposed in said recessed caulking groove and being fastened to said wall, and arranged to extend from at least the height of said crack and downwardly to a preselected foundation opening formed adjacent the base of said wall.

7. The wall drainage system of claim 6, wherein said wall patch is fastened to the wall surface by means of threaded screws seated in longitudinally spaced apertures longitudinally spaced along each of said curbs.

8. The wall drainage system of claim 6, wherein said wall patch is relatively flat and being arranged to cover drainage crack(s) lying thereunder.

9. The wall drainage system of claim 6, wherein said wall patch is arranged to cover a crack occurring in an inside corner area of said inner foundation wall, and wherein the patch includes an angular bend intermediate its length and in a direction opposed to the surface containing the pair of curbs.

10. The wall drainage system of claim 6, wherein said patch is configured to provide abutting, angularly disposed, patch portions adapted to cover and drain at least one wall crack angularly located relative to the drain opening formed at base of said foundation wall.

* * * * *